US008052236B2

(12) United States Patent
Kim

(10) Patent No.: US 8,052,236 B2
(45) Date of Patent: Nov. 8, 2011

(54) REFRIGERATOR

(75) Inventor: Seong Wook Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/634,563

(22) Filed: Dec. 9, 2009

(65) Prior Publication Data

US 2010/0176702 A1 Jul. 15, 2010

Related U.S. Application Data

(60) Provisional application No. 61/145,060, filed on Jan. 15, 2009.

(51) Int. Cl.
*A47B 96/04* (2006.01)

(52) U.S. Cl. ..... 312/405.1; 312/408; 312/321.5

(58) Field of Classification Search ..... 312/405.1, 312/321.5, 404, 408, 351; 108/193, 147.16, 108/147.17; 62/441, 465; 248/241, 243, 248/250; 311/90.02, 90.04, 103, 187, 190, 311/207; 292/163, 174, 175, 145, 300, DIG. 71
See application file for complete search history.

(56) References Cited

U.S. PATENT DOCUMENTS

| | | | | | |
|---|---|---|---|---|---|
| 293,424 | A * | 2/1884 | Copeland et al. | 292/169.21 |
| 728,670 | A * | 5/1903 | Carlson | 292/175 |
| 860,770 | A * | 7/1907 | Tait | 292/175 |
| 888,754 | A * | 5/1908 | Schuff | 108/146 |
| 2,841,459 | A * | 7/1958 | Sharpe | 312/306 |
| 3,610,174 | A * | 10/1971 | Kesling | 108/56.1 |
| 3,666,338 | A * | 5/1972 | Russell | 312/215 |
| 3,885,846 | A * | 5/1975 | Chuang et al. | 312/306 |
| 3,982,801 | A * | 9/1976 | Heidorn et al. | 312/306 |
| 5,004,305 | A * | 4/1991 | Montuoro et al. | 312/405.1 |
| 5,441,338 | A * | 8/1995 | Kane et al. | 312/408 |
| 5,467,721 | A * | 11/1995 | Gosch | 108/146 |
| 5,913,584 | A * | 6/1999 | Swindell et al. | 312/408 |
| 6,065,821 | A * | 5/2000 | Anderson et al. | 312/408 |
| 6,364,136 | B1 * | 4/2002 | Weshler et al. | 211/90.02 |
| 6,582,038 | B2 * | 6/2003 | Moreno-Olguin et al. | 312/405.1 |
| 7,178,890 | B2 * | 2/2007 | Park et al. | 312/408 |
| 2007/0159041 | A1 * | 7/2007 | Lucas et al. | 312/408 |
| 2008/0246382 | A1 * | 10/2008 | Kang et al. | 312/408 |
| 2010/0117502 | A1 * | 5/2010 | Kang et al. | 312/408 |
| 2010/0175414 | A1 * | 7/2010 | Kim | 62/377 |

FOREIGN PATENT DOCUMENTS

WO WO 2008130114 A1 * 10/2008

* cited by examiner

*Primary Examiner* — Darnell Jayne

*Assistant Examiner* — Kimberley Wright

(74) *Attorney, Agent, or Firm* — Birch, Stewart, Kolasch & Birch, LLP

(57) ABSTRACT

Provided is a refrigerator. The refrigerator includes a main body defining a storage compartment, a refrigerator door for opening or closing the storage compartment, and a basket height-adjustably provided on the refrigerator door.

7 Claims, 6 Drawing Sheets

REFRIGERATOR

This Non-Provisional application claims priority under 35 U.S.C. 119(e) on U.S. Provisional Application No. 61/145,060, filed on Jan. 15, 2009, the entire contents of which are hereby incorporated by reference.

BACKGROUND

Embodiments relate to a refrigerator.

Generally, a refrigerator is an appliance that can store foods at a low temperature using cool air supplied into a storage compartment.

The refrigerator includes a main body defining the storage compartment and a door moveably coupled to the main body to open or close the storage compartment.

A basket for conveniently storing the foods is provided on a back surface (a surface toward the storage compartment) of the door.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
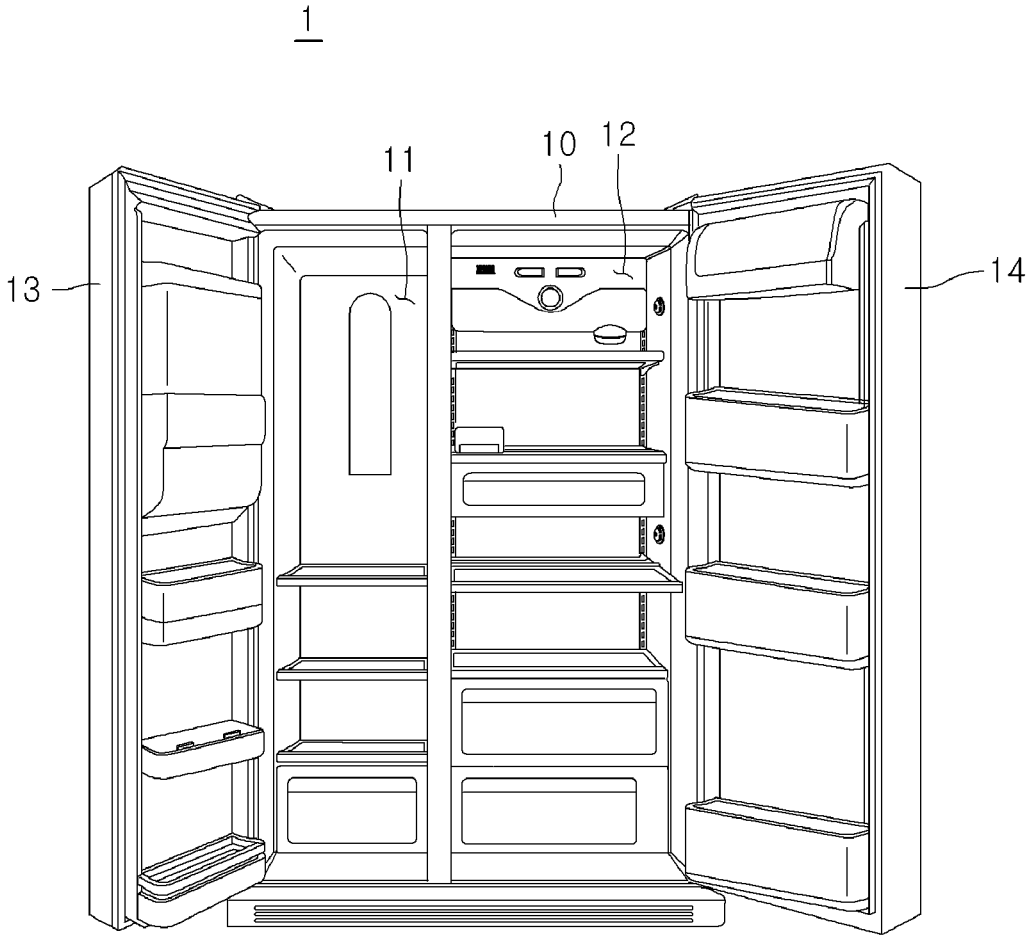
FIG. 1 is a perspective view of a refrigerator according to an embodiment.
Figure 2:
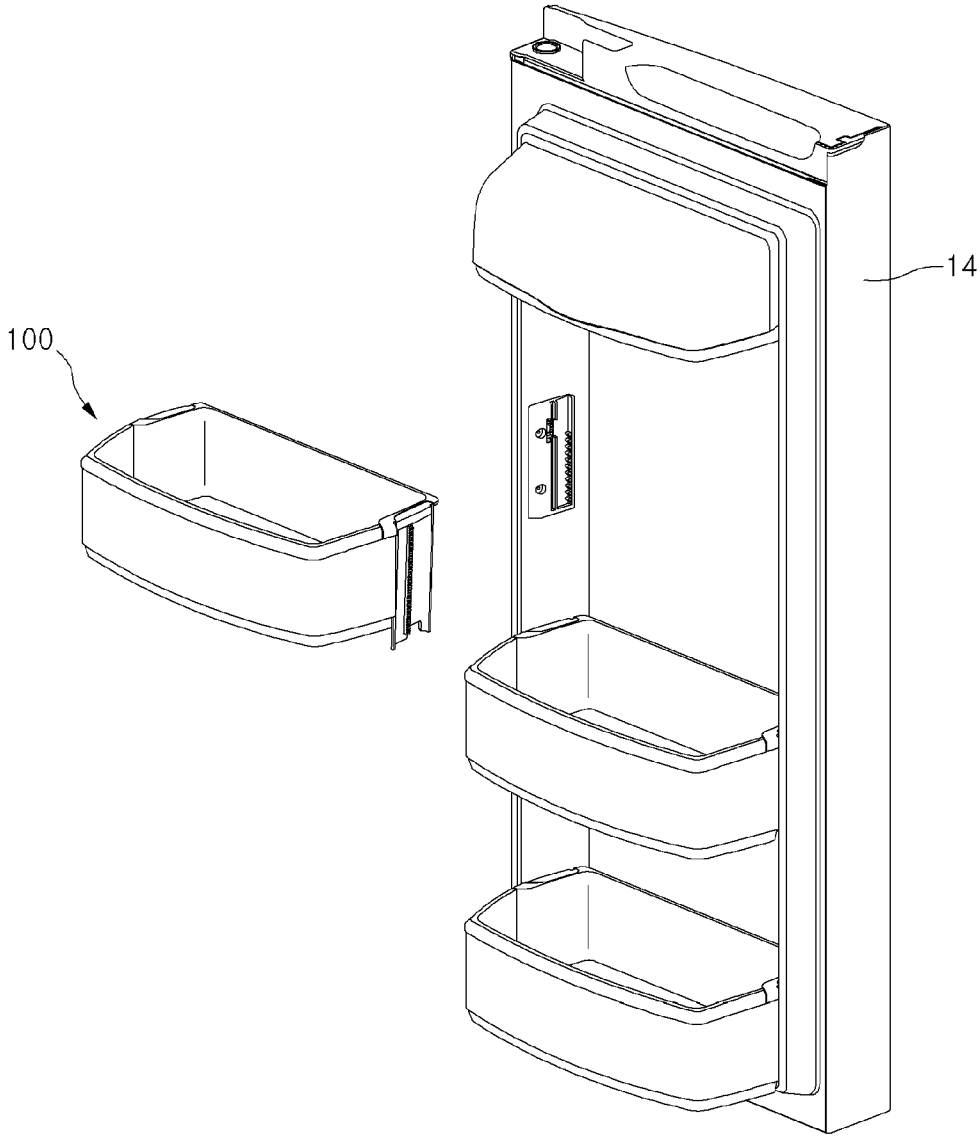
FIG. 2 is a perspective view of a refrigerator compartment door.

FIG. 1 is a perspective view of a refrigerator according to an embodiment, and FIG. 2 is a perspective view of a refrigerator compartment door.

Although a side by side type refrigerator in which a refrigerator compartment and a freezer compartment are respectively disposed in left and right sides is illustrated in FIG. 1 as an example, the present disclosure is not limited thereto. For example, a refrigerator according to this embodiment may be applied to following various refrigerators: a top mount type refrigerator in which a refrigerator compartment is disposed under a freezer compartment; a bottom freezer type refrigerator in which a refrigerator compartment is disposed above a freezer compartment; and a refrigeration or freezing equipment provided with any one of a refrigerator compartment and a freezer compartment.

Referring to FIG. 1, a refrigerator 1 according to this embodiment includes a main body 10 defining a storage compartment and a door coupled to the main body 10 to open or close the storage compartment.

The storage compartment includes a freezer compartment 11 and a refrigerator compartment 12. The freezer compartment 11 and the refrigerator compartment 12 are disposed at left and right sides, respectively.

The door includes a freezer compartment door 13 for opening or closing the freezer compartment 11 and a refrigerator compartment door 14 for opening or closing the refrigerator compartment 12. Each of the doors 13 and 14 is rotatably coupled to the main body 10 using a hinge.

One or more baskets 100 for conveniently storing foods are provided on a back surface of each of the doors 13 and 14. Here, the back surface of each of the doors 13 and 14 denotes a surface toward the storage compartment in a state where each of the doors 13 and 14 is closed.

The baskets 100 are moved upward and downward in a state where the baskets 100 are installed on each of the doors 13 and 14. Thus, a user may adjust heights (heights from a bottom surface) of the baskets 100 to adjust positions for storing the foods. As a result, the positions of the baskets 10 may be optimized on the back surface of each of the doors 13 and 14.

The baskets 100 disposed on the refrigerator compartment door 14 are illustrated in FIG. 2 as an example.

Hereinafter, for convenience in description, the freezer compartment door 13 and the refrigerator compartment door 14 are referred to as refrigerator doors 13 and 14.

Figure 3:
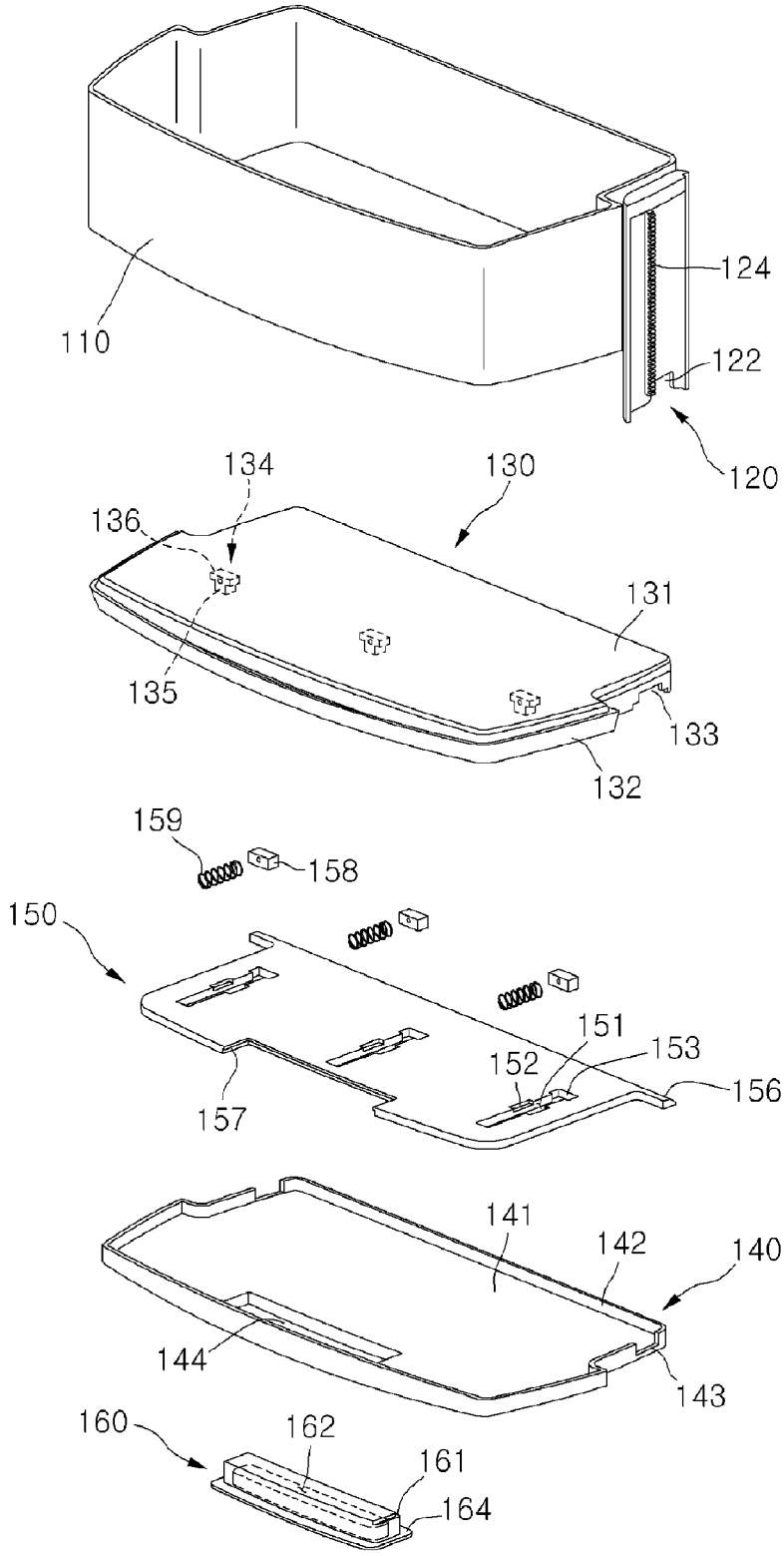
FIG. 3 is an exploded perspective view of a basket according to an embodiment.
Figure 4:
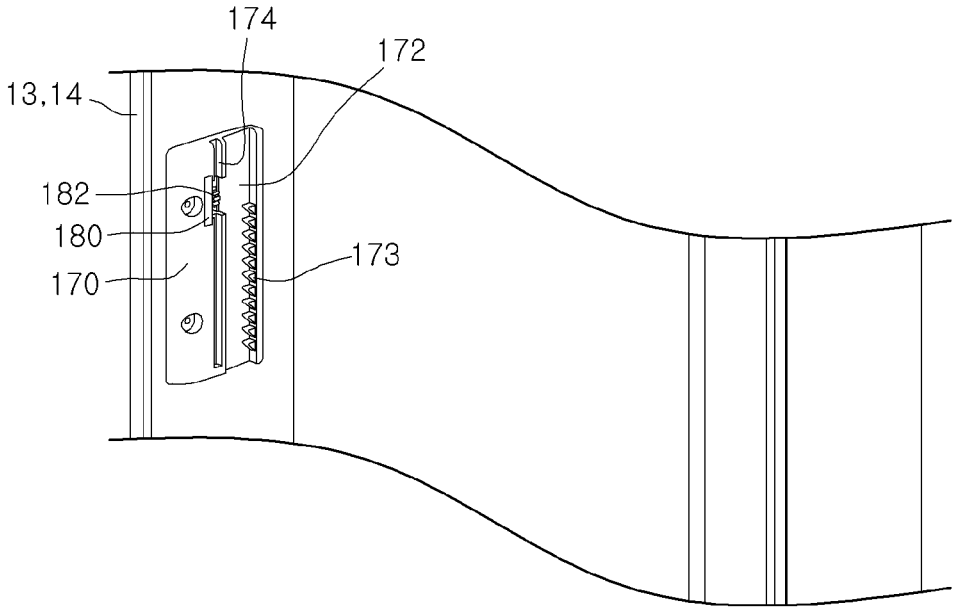
FIG. 4 is a perspective view of a refrigerator compartment door from which a basket is separated.

FIG. 3 is an exploded perspective view of a basket according to an embodiment, and FIG. 4 is a perspective view of a refrigerator compartment door from which a basket is separated.

Referring to FIGS. 3 and 4, a basket 100 includes a case 110 defining a space for storing foods. The case 110 has an opened top surface.

A plurality of first guide parts 120 for vertically guiding a movement of the case 110 is provided on both sides of the case 110. A rack gear 124 is provided on each of the first guide parts 120. The rack gear 124 is vertically disposed in upward and downward directions. The rack gear 124 prevents the basket 100 from suddenly descending due to a self-weight of the basket 100.

That is, the rack gear 124 reduces a descending speed of the basket 100 by interacting with a pinion gear 182 that will be described later.

An opening 122 for preventing interference with a coupling member 150 that will be described later is defined in a lower portion of the first guide part 120.

The basket 100 includes the coupling member 150, a first cover 130, and a second cover 140 in order to maintain an adjusted height of the basket 100. The coupling member 150 is selectively coupled to a second guide part 170 provided on each of refrigerator doors 13 and 14. The first and second covers 130 and 140 protect the coupling member 150.

The first cover 130 is coupled to a lower side of the case 110, and the second cover 140 is coupled to a lower side of the first cover 130. The coupling member 140 is disposed between the first cover 130 and the second cover 140.

The first cover 130 includes a first cover body 131 and a first extending part 132 extending downwardly from a circumference of the first cover body 131. An opening 133 through which a portion of the coupling member 150 passes is defined in the first extending part 132.

A plurality of guide members 134 passing through the coupling member 150 and guiding a movement of the coupling member 150 is provided on a bottom surface of the first cover body 131.

The plurality of guide members 134 guides a translation movement of the coupling member 150 in one direction, and simultaneously, prevents the coupling member 150 from being translated or rotated in the other direction.

Each of the guide members 134 includes an insertion part 135 inserted into the coupling member 150 and a protrusion part 136 extending in both sides direction from an upper portion of the insertion part 135.

An insertion hole 151 in which the insertion part 135 is inserted is defined in the coupling member 150. Guide recesses 152 on which the protrusion part 136 is seated are disposed in both side portions of the insertion hole 151. Each of the guide recesses 152 is depressed downwardly from a top surface of the coupling member 150.

In FIG. 3, a width of front and rear directions of the guide recess 152 is greater than that of front and rear directions of the protrusion part 136. Thus, the protrusion part 136 is relatively moved with the coupling member 150 within a range of the width of the front and rear directions of the guide recess 152.

The insertion part 135 is supported by an elastic member 159 in a state where the insertion part 135 is inserted into the insertion hole 151. For example, the elastic member 159 may includes a coil spring.

A support insertion hole 153 in which a support 158 for supporting the elastic member 159 is inserted is defined in the coupling member 150. That is, the elastic member 159 has one end supported by the insertion part 135 and the other end supported by the support 158.

The support 158 is moved together with the coupling member 150 in a state where the support 158 is inserted into the support insertion hole 153. That is, the insertion part 153 and the support 158 are relatively moved according to a movement of the coupling member 150.

Hook ends 156 selectively hooked with stoppers 173 of the second guide part 170 are disposed on both sides of the coupling member 150.

The hook ends 156 protrude outwardly from both side surfaces of the coupling member 150. Each of the hook ends 156 is disposed in the opening 133.

In order to allow the hook end 156 to be moved when the coupling member 150 is moved in the front and rear directions, a width of front and rear directions of the opening 133 is greater than that of front and rear directions of the hook end 156.

A coupling part 157 to which a handle 160 that will be described later is coupled is disposed in the coupling member 150.

The second cover 140 includes a second cover body 141 and a second extending part 142 protruding upwardly from a circumference of the second cover body 141. An opening 143 through which the hook end 156 passes is defined in the second extending part 142.

In order to allow the hook end 156 to be moved when the coupling member 150 is moved in the front and rear directions, a width of front and rear directions of the opening 143 is greater than that of the front and rear directions of the hook end 156. When the first cover 130 is coupled to the second cover 140, the first extending part 132 surrounds an outer surface of the second extending part 142.

A hole 144 through which the handle 160 passes is defined in the second cover body 141.

The handle 160 is coupled to the coupling part 157 of the coupling member 150 in a state where the handle 160 passes through the hole 144 from a lower side of the second cover 140. The handle 160 includes a handle body 161 and a flange 164. The handle body defines a receiving part 162 for receiving user's hands or fingers. The flange 164 extends in a horizontal direction in a lower portion of the handle body 161 to contact with a bottom surface of the second cover body 141.

A plurality of guide parts 170 is coupled to the refrigerator doors 13 and 14.

A first guide recess 172 for allowing the hook end 156 to be vertically moved is disposed in each of the second guide parts 170. The first guide recess extends in upward and downward directions.

The plurality of stoppers 173 on which the hook end 156 is selectively hooked is disposed in the first guide recess 172. The stoppers 173 are vertically spaced from each other. When the hook end 156 is disposed between a specific stopper and an adjacent stopper, a position of the basket 100 is fixed.

In order to allow the hook end 156 to be moved in front and rear directions within the guide recess 172, a width of front and rear directions of the first guide recess 172 is greater than that of front and rear directions of the stopper 156.

The pinion gear 182 engaged with the rack gear 124 is provided on the second guide part 170. The pinion gear 182 is supported by a support member 180, and the support member 180 is coupled to the second guide part 170.

A second guide recess 174 for guiding a vertical movement of the rack gear 124 in a state where the rack gear 124 is engaged with the pinion gear 182 is disposed in the second guide part 170. The second guide part 174 is vertically disposed along the second guide part 170.

Thus, since the rack gear 124 is vertically moved in a state where the rack gear 124 is disposed in the second guide recess 174, the basket 100 can be stably moved in upward and downward directions without shaking in front and rear directions.

Hereinafter, the vertical movement of the basket will be described.

Figure 5:
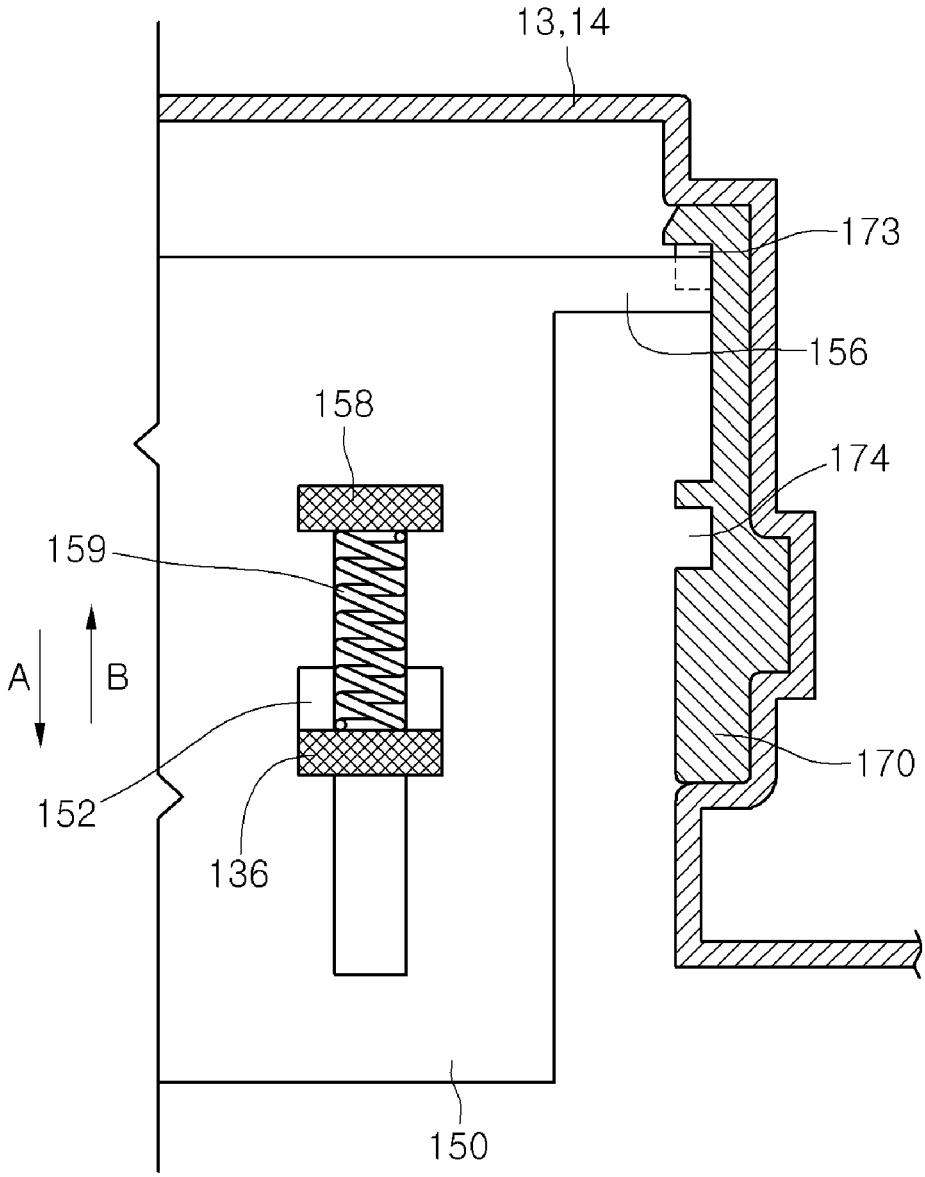
FIG. 5 is a view of a state in which a hook end of a coupling member is coupled to a second guide part.
Figure 6:
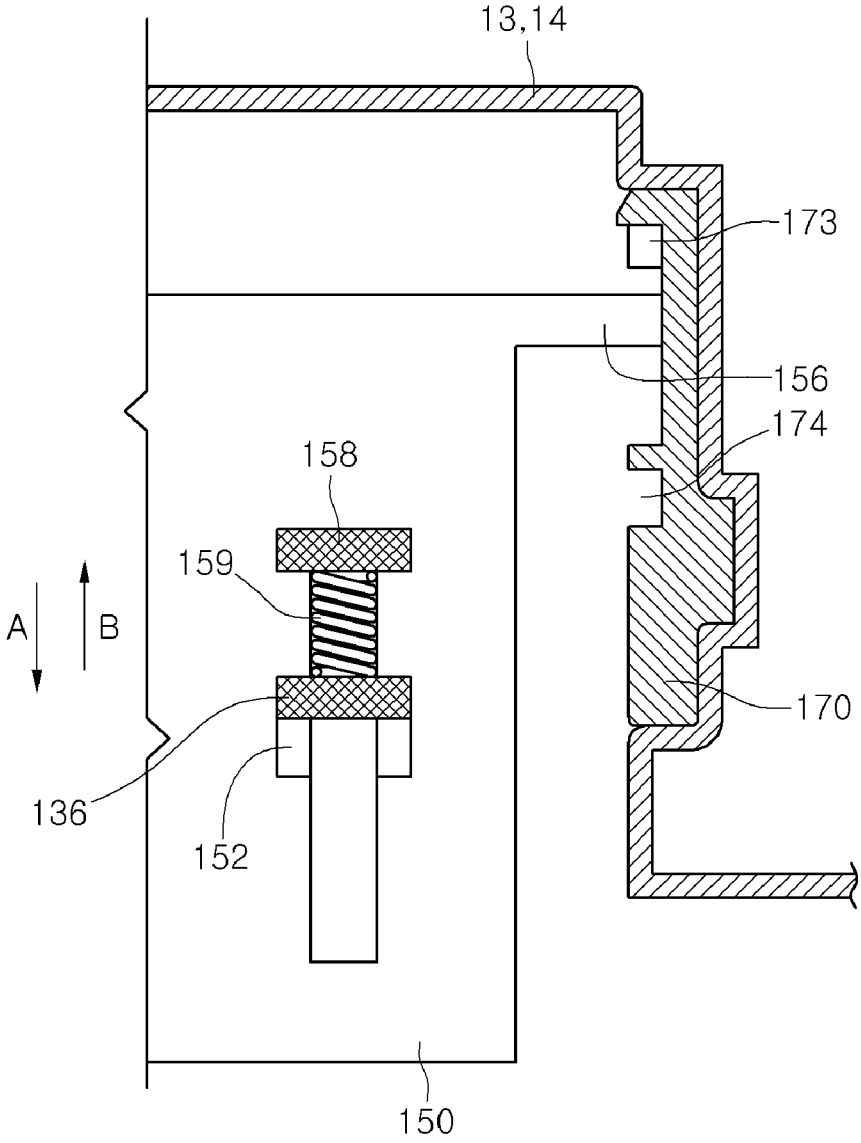
FIG. 6 is a view of a state in which coupling between a hook end of a coupling member and a second guide part is released.

FIG. 5 is a view of a state in which a hook end of a coupling member is coupled to a second guide part, and FIG. 6 is a view of a state in which coupling between a hook end of a coupling member and a second guide part is released.

Referring to FIGS. 3 to 6, in order to move the basket 100 in an upward or downward direction, first, the user grasps the handle 160 and pulls the coupling member 150 toward himself or herself. Then, the coupling member 150 is moved in a front direction (direction A when viewed in FIG. 5). As a result, since the support 158 pressurizes the elastic member 159, the elastic member 159 shrinks. When a hooking engagement between the hook end 156 and the stopper 173 is released, the basket 100 is movable vertically. Thus, the user moves the basket 100 in an upward or downward direction in a state where the user pulls the coupling member 150. Here, when the basket 100 is moved in the upward or downward direction, the rack gear 124 is positioned in the guide recess 172 in a state where the rack gear 124 is engaged with the pinion gear 182. Therefore, the basket 100 can be stably movable in the upward or downward direction.

As described above, when the basket 100 is moved in the downward direction, the rack gear 124 can interact with the pinion gear 182 to prevent the basket 100 from suddenly descending due to the self-weight of the basket 100.

A force pulling the coupling member 150 is removed in a state where the basket 100 is moved in the upward or downward direction. Then, the coupling member 150 is moved in a direction away from the user due to a force of restitution of the elastic member 159. That is, the coupling member 150 is moved in a rear direction (direction B when viewed in FIG. 5).

The hook end 156 is disposed between two specific stoppers 173 to fix the position of the basket 100.

According to this embodiment, the height of the basket can be adjusted by manipulating the coupling member without separating the basket from the refrigerator doors 13 and 14, thereby improving user's convenience.

In addition, the descending speed of the basket can be reduced by the interaction between the rack gear and the pinion gear to prevent the basket from suddenly descending.

What is claimed is:

1. A refrigerator, comprising:

a body having a door;

a plurality of stoppers on the inner side of the door, the stoppers being vertically aligned;

a basket disposed on the door;

a cover comprising a first cover coupled to a lower side of the basket and a second cover coupled to a lower side of the first cover;

a coupling member movably mounted in a front and rear direction inside of the cover;

an insertion hole located in the coupling member and extending in the front and rear direction;

a guide member provided on a bottom surface of the first cover, the guide member passing through the insertion hole and guiding movement of the coupling member;

a pair of projections extending from the coupling member, the pair of projections being retractable to selectively engage or disengage the stoppers;

an elastic member supported by the cover and the coupling member to apply an elastic force to the coupling member; a support on the coupling member; and a handle coupled to the coupling member and exposed from a lower side of the cover, the handle allowing the coupling member to be moved to disengage the projections from the stoppers wherein the elastic member is supported between the guide member and the support.

2. The refrigerator of claim 1, further comprising:

a protrusion part extending in both side directions from an upper portion of the guide member; and a pair of guide recesses depressed downwardly in both side portions of the insertion hole to accommodate the protrusion part, wherein the protrusion part moves relative to the coupling member within a range of the width in the front and rear direction of the guide recesses.

3. The refrigerator of claim 1, further comprising:

a pair of openings in the sides of the cover, the pair of projections passing through the pair of openings.

4. The refrigerator of claim 1, further comprising:

a pair of first guide parts provided on both sides of the basket to guide vertical movement;

a rack gear vertically disposed on each of the first guide parts;

a pair of second guide parts are mounted on both sides of the door; and a pinion gear provided on the second guide parts and engaged with the rack gear on the first guide parts, wherein the first guide parts and the basket are stably moved in an upward and downward direction along the second guide parts.

5. The refrigerator of claim 4, wherein the plurality of stoppers are formed in an first guide recess which is extended in upward and downward directions on the second guide parts.

6. The refrigerator of claim 5, wherein the pair of projections protrude through the first guide parts and are selectively hooked with the plurality of stoppers inside of the first guide recess.

7. The refrigerator of claim 4, wherein the rack gear vertically moves in a second guide recess which extends vertically on the second guide parts.

* * * * *